US008834714B2

(12) United States Patent
Chien

(10) Patent No.: US 8,834,714 B2
(45) Date of Patent: Sep. 16, 2014

(54) MOVABLE FILTER GRID FOR A DRAIN INLET

(71) Applicant: Yu-Chia Chien, Su'ao Township, Yilan County (TW)

(72) Inventor: Yu-Chia Chien, Su'ao Township, Yilan County (TW)

( * ) Notice: Subject to any disclaimer, the term of this patent is extended or adjusted under 35 U.S.C. 154(b) by 0 days.

(21) Appl. No.: 14/074,407

(22) Filed: Nov. 7, 2013

(65) Prior Publication Data

US 2014/0158593 A1 Jun. 12, 2014

(30) Foreign Application Priority Data

Dec. 12, 2012 (TW) ..... 101224045 A
Jun. 14, 2013 (TW) ..... 102211133 A

(51) Int. Cl.
*E03F 5/06* (2006.01)
*E03F 5/14* (2006.01)

(52) U.S. Cl.
USPC ..... 210/163; 210/166

(58) Field of Classification Search
None
See application file for complete search history.

(56) References Cited

U.S. PATENT DOCUMENTS 853,598 A * 5/1907 Rile ..... 210/166
1,252,573 A * 1/1918 Holt ..... 210/166
1,266,948 A * 5/1918 Holt ..... 210/166
1,348,945 A * 8/1920 Hirshstein ..... 210/166
1,487,161 A * 3/1924 Holt ..... 210/166
1,582,646 A * 4/1926 Flesch et al. ..... 210/166
1,593,550 A * 7/1926 Holt ..... 210/166
1,674,347 A * 6/1928 Silverman ..... 210/166
1,690,630 A * 11/1928 Fleming ..... 210/166
1,721,472 A * 7/1929 Rose ..... 210/166
1,753,262 A * 4/1930 Cromwell ..... 210/166
1,761,257 A * 6/1930 Fleming ..... 210/166
1,762,838 A * 6/1930 Shand ..... 210/166
1,791,512 A * 2/1931 Schurman ..... 210/163
1,838,092 A * 12/1931 Cromwell ..... 285/42
1,862,134 A * 6/1932 Boosey ..... 210/163
1,918,509 A * 7/1933 Wilcox ..... 210/166
1,973,321 A * 9/1934 Schultz ..... 210/163
1,988,669 A * 1/1935 Sommerfeld ..... 210/166
1,991,772 A * 2/1935 Rieger et al. ..... 210/166
1,999,277 A * 4/1935 Boosey ..... 210/163
2,091,927 A * 8/1937 Hirshstein ..... 285/341
2,121,220 A * 6/1938 Filkins ..... 210/166
2,142,343 A * 1/1939 Boosey ..... 210/166
2,256,626 A * 9/1941 Rile ..... 210/166
2,283,365 A * 5/1942 Heinkel ..... 137/328
2,284,416 A * 5/1942 Gordon ..... 210/166
2,311,654 A * 2/1943 Filkins ..... 210/166
2,572,208 A * 10/1951 Sievert ..... 210/166
2,599,205 A * 6/1952 Schmid ..... 210/166
2,666,493 A * 1/1954 Gordon ..... 210/166

(Continued)

*Primary Examiner* — Robert James Popovics
(74) *Attorney, Agent, or Firm* — C. G. Mersereau; Nikolai & Mersereau, P.A.

(57) ABSTRACT

A movable filter grid for a drain inlet has a drain grill, an annular seat and an annular fastener. The drain grill has an annular plate and multiple support ribs. A first end of each support rib is connected to an outer circumferential edge of the annular plate, and a second end of the support rib radially extends outwards from the annular plate. An inner wall of an annular seat is securely connected to the second ends of the support ribs. The annular fastener has multiple pin holders annularly connected. Each pin holder has a through hole vertically formed through the pin holder and detachably mounted through by a pin. When the movable filter grid is applied to drain inlets on different terrains, the pins taking the form of a grating can prevent debris from blocking the drain holes.

10 Claims, 8 Drawing Sheets

(56) References Cited

U.S. PATENT DOCUMENTS

| | | | | | |
|---|---|---|---|---|---|
| 2,740,490 | A | * | 4/1956 | Matheis | 210/166 |
| 2,762,448 | A | * | 9/1956 | Schmid et al. | 210/166 |
| 2,765,865 | A | * | 10/1956 | Schmid | 210/166 |
| 2,837,212 | A | * | 6/1958 | Schmid | 210/166 |
| 2,881,921 | A | * | 4/1959 | Baker et al. | 210/166 |
| 2,888,138 | A | * | 5/1959 | Baker et al. | 210/166 |
| 3,121,682 | A | * | 2/1964 | Alberico | 210/166 |
| 3,245,540 | A | * | 4/1966 | Johnson | 210/291 |
| 3,357,561 | A | * | 12/1967 | Schmid et al. | 210/163 |
| 3,378,858 | A | * | 4/1968 | Candido | 210/163 |
| 3,469,698 | A | * | 9/1969 | Blendermann | 210/163 |
| 3,469,699 | A | * | 9/1969 | Blendermann et al. | 210/166 |
| 3,517,813 | A | * | 6/1970 | Kunibert | 210/166 |
| 3,529,723 | A | * | 9/1970 | Hagedorn | 210/163 |
| 3,731,815 | A | * | 5/1973 | Collingwood et al. | 210/496 |
| 3,855,737 | A | * | 12/1974 | Clark | 451/364 |
| 3,884,809 | A | * | 5/1975 | Logsdon | 210/163 |
| 3,893,919 | A | * | 7/1975 | Flegel et al. | 210/166 |
| 3,909,412 | A | * | 9/1975 | Patry | 210/166 |
| 4,035,297 | A | * | 7/1977 | Aldridge et al. | 210/163 |
| D249,955 | S | * | 10/1978 | Vogelsang | D23/261 |
| 4,170,047 | A | * | 10/1979 | Corsette et al. | 4/293 |
| 4,216,790 | A | * | 8/1980 | Stoltz | 137/357 |
| 4,275,506 | A | * | 6/1981 | Knoll | 33/561.2 |
| 4,400,272 | A | * | 8/1983 | Logsdon | 210/166 |
| 4,418,432 | A | * | 12/1983 | Vidal | 4/286 |
| 4,460,462 | A | * | 7/1984 | Arneson | 210/163 |
| 4,471,497 | A | * | 9/1984 | Riutort et al. | 4/286 |
| 4,487,690 | A | * | 12/1984 | Logsdon | 210/163 |
| 4,505,499 | A | * | 3/1985 | Uglow et al. | 285/42 |
| 4,505,814 | A | * | 3/1985 | Marshall | 210/166 |
| 4,525,273 | A | * | 6/1985 | Logsdon | 210/164 |
| 4,652,365 | A | * | 3/1987 | Ebeling | 210/163 |
| 4,658,449 | A | * | 4/1987 | Martin | 4/496 |
| 4,799,713 | A | * | 1/1989 | Uglow | 285/42 |
| D319,295 | S | * | 8/1991 | Ohaus | D23/261 |
| 5,141,633 | A | * | 8/1992 | Walczak et al. | 210/163 |
| 5,234,582 | A | * | 8/1993 | Savoie | 210/163 |
| D341,413 | S | * | 11/1993 | Nichols | D23/261 |
| D343,228 | S | * | 1/1994 | Colin | D23/261 |
| 5,297,895 | A | * | 3/1994 | Johnson | 405/41 |
| 5,394,657 | A | * | 3/1995 | Peterson | 52/12 |
| 5,469,670 | A | * | 11/1995 | Thaler | 52/12 |
| 5,526,613 | A | * | 6/1996 | Simeone, Jr. | 52/12 |
| 5,615,526 | A | * | 4/1997 | Palmer et al. | 52/302.1 |
| 5,618,416 | A | * | 4/1997 | Haefner | 210/163 |
| 5,650,065 | A | * | 7/1997 | Sewell | 210/166 |
| 5,688,013 | A | * | 11/1997 | Sehrt | 294/99.1 |
| 5,689,928 | A | * | 11/1997 | Rasksen | 52/302.1 |
| 5,724,684 | A | * | 3/1998 | Paar | 4/288 |
| 5,724,777 | A | * | 3/1998 | Hubbard | 52/198 |
| 5,733,444 | A | * | 3/1998 | Johnson | 210/163 |
| 5,734,999 | A | * | 4/1998 | Nicholas | 4/507 |
| 5,735,091 | A | * | 4/1998 | Hawkins et al. | 52/302.7 |
| 5,744,048 | A | * | 4/1998 | Stetler | 210/803 |
| 5,799,339 | A | * | 9/1998 | Perry et al. | 4/286 |
| 5,843,306 | A | * | 12/1998 | Singleton | 210/163 |
| 5,926,865 | A | * | 7/1999 | Witinski et al. | 4/496 |
| 5,966,884 | A | * | 10/1999 | Uglow | 52/302.1 |
| 6,004,457 | A | * | 12/1999 | Singleton | 210/163 |
| 6,053,026 | A | * | 4/2000 | Nardiello et al. | 72/413 |
| 6,165,357 | A | * | 12/2000 | Cormier | 210/163 |
| 6,170,095 | B1 | * | 1/2001 | Zars | 4/507 |
| 6,209,586 | B1 | * | 4/2001 | Wright | 138/96 R |
| 6,261,445 | B1 | * | 7/2001 | Singleton | 210/163 |
| D446,844 | S | * | 8/2001 | Claussen et al. | D23/261 |
| 6,295,661 | B1 | * | 10/2001 | Bromley | 4/504 |
| 6,340,035 | B2 | * | 1/2002 | Wright | 138/96 R |
| 6,393,631 | B2 | * | 5/2002 | Schroader | 4/504 |
| 6,397,408 | B1 | * | 6/2002 | Veloskey et al. | 4/504 |
| 6,408,452 | B1 | * | 6/2002 | Bromley | 4/504 |
| D460,810 | S | * | 7/2002 | Sommerhein | D23/261 |
| 6,416,674 | B1 | * | 7/2002 | Singleton et al. | 210/747.3 |
| 6,428,693 | B2 | * | 8/2002 | Singleton | 210/163 |
| 6,453,482 | B1 | * | 9/2002 | Mullings | 4/507 |
| D466,198 | S | * | 11/2002 | Mullings | D23/261 |
| 6,557,588 | B2 | * | 5/2003 | Wright | 138/96 R |
| 6,588,029 | B2 | * | 7/2003 | Mullings | 4/507 |
| 6,631,588 | B1 | * | 10/2003 | Distler | 52/12 |
| 6,817,043 | B2 | * | 11/2004 | Zars | 4/504 |
| 6,833,067 | B2 | * | 12/2004 | Dresmann | 210/163 |
| 7,005,061 | B1 | * | 2/2006 | Downs et al. | 210/163 |
| 7,108,783 | B2 | * | 9/2006 | Glazik | 210/163 |
| 7,300,573 | B1 | * | 11/2007 | Trangsrud | 210/163 |
| 7,346,938 | B2 | * | 3/2008 | Mattson et al. | 4/507 |
| 7,407,574 | B2 | * | 8/2008 | Robinson | 210/163 |
| 7,415,802 | B2 | * | 8/2008 | Froeter et al. | 52/302.1 |
| D576,257 | S | * | 9/2008 | Rattenbury | D23/260 |
| 7,419,588 | B2 | * | 9/2008 | Lawson | 210/164 |
| D578,619 | S | * | 10/2008 | Rattenbury | D23/261 |
| 7,442,296 | B2 | * | 10/2008 | Chong et al. | 210/163 |
| D598,523 | S | * | 8/2009 | McAlpine | D23/268 |
| D598,987 | S | * | 8/2009 | McAlpine | D23/268 |
| 7,614,198 | B1 | * | 11/2009 | Piskula et al. | 52/741.1 |
| 7,718,055 | B2 | * | 5/2010 | Iou | 210/156 |
| 7,784,242 | B2 | * | 8/2010 | Warnecke | 52/745.16 |
| 7,854,838 | B2 | * | 12/2010 | Martin | 210/163 |
| D669,969 | S | * | 10/2012 | Forrest et al. | D23/261 |
| 8,496,822 | B2 | * | 7/2013 | Schoell et al. | 210/232 |
| 8,557,108 | B2 | * | 10/2013 | Rennels | 210/163 |
| 8,557,109 | B1 | * | 10/2013 | Sutherland | 210/163 |
| 8,628,657 | B1 | * | 1/2014 | Robillard et al. | 210/163 |
| 8,679,328 | B2 | * | 3/2014 | Hebert | 210/163 |
| 2001/0023842 | A1 | * | 9/2001 | Singleton | 210/163 |
| 2008/0251470 | A1 | * | 10/2008 | Kent | 210/791 |
| 2010/0025312 | A1 | * | 2/2010 | Martin | 210/170.03 |
| 2012/0222996 | A1 | * | 9/2012 | Rennels | 210/163 |
| 2013/0264256 | A1 | * | 10/2013 | Hebert | 210/163 |
| 2014/0158593 | A1 | * | 6/2014 | Chien | 210/166 |

* cited by examiner

MOVABLE FILTER GRID FOR A DRAIN INLET

BACKGROUND OF THE INVENTION

1. Field of the Invention

The present invention relates to a filter grid and, more particularly, to a movable filter grid for a drain inlet that can be conveniently mounted on irregular terrains.

2. Description of the Related Art

Flooding in urban areas is oftentimes caused by blocked drains and sewers. Effective sewer drainage depends on constant cleanup of foreign matters, such as garbage, plastic bags, tree leaves, stones and the like. However, the constant cleanup is not sufficient to meet the need of a modernized society. To further avoid cloggage in sewers, drain covers and drain gates are mounted on floor drain outlets to prevent debris from entering sewer lines or blocking household drain pipes.

With reference to FIG. 8, a conventional drain grate 90 has a support frame 92, a filter frame 91, and a mounting seat 93. The filter frame 91 is formed on a top of the support frame 92, and has multiple drain holes disposed in grate shape and formed through the filter frame 91. The mounting seat 93 is formed on a bottom of the support frame 92 and is mounted on a drain inlet. Although the conventional drain grate 90 can block debris flowing with water outside the drain inlet during a raining day, the drain grate 90 has the following drawbacks in design.

As the drain grate 90 is designed to match the drain inlet in size, the drain holes on the filter frame 91 are usually not every large. When tree leaves and scrape papers with sizes larger than a drain inlet flow to the drain inlet, the drain grate 90 can block out the tree leaves and scrape papers while the tree leaves and the scrape papers are left on the filter frame 91 to cover the drain holes of the filter frame 91. Normal drainage through the drain inlet is certainly affected and flooding arises accordingly.

SUMMARY OF THE INVENTION

An objective of the present invention is to provide a movable filter grid for a drain inlet that can be flexibly mounted on a drain inlet and closely contact the ground to effectively block debris and can be cleaned up easily.

To achieve the foregoing objective, the movable filter grid has a drain grill, an annular seat and an annular fastener.

The drain grill has an annular plate and multiple support ribs. A first end of each support rib is connected to an outer circumferential edge of the annular plate, and a second end of the support rib radially extends outwards from the annular plate.

An inner wall of the annular seat is securely connected to the second ends of the support ribs.

An annular fastener has multiple pin holders annularly connected. Each pin holder has a holding slot and a through hole.

The holding slot is formed in a bottom of the pin holder for the pin holder to be mounted on the annular seat.

The through hole is vertically formed through an outer edge portion of the pin holder. A pin is detachably mounted through each through hole. The inserted pins take a form of a grating.

To achieve the foregoing objective, alternatively, the movable filter grid has a drain grill and multiple pins.

The drain grill has an upper ring, a lower ring and multiple support ribs.

The upper ring is formed on a top end of the drain grill.

The lower ring is formed on a bottom end of the drain grill and has multiple tubes annularly formed on an outer periphery of the lower ring and mutually spaced apart by a space. Each tube has a through hole vertically formed through the tube.

The support ribs are radially formed between the upper ring and the lower ring.

The pins are respectively movably inserted into the through holes of the tube in a vertical direction and take the form of a grating.

Given the foregoing structures of the movable filter grid, the pins taking the form of a grating can flexibly and closely contact the ground to suit for the mounting of the movable filter grid on a flat ground or non-flat ground. After the pins contact the ground, the pins are pulled upwards so that the pins can form a grating around the movable filter grid to fence off tree leaves or debris to enlarge a range of filtering debris and facilitate easy clean-up of the movable filter grid.

Other objectives, advantages and novel features of the invention will become more apparent from the following detailed description when taken in conjunction with the accompanying drawings.

DETAILED DESCRIPTION OF THE INVENTION

Figure 1:
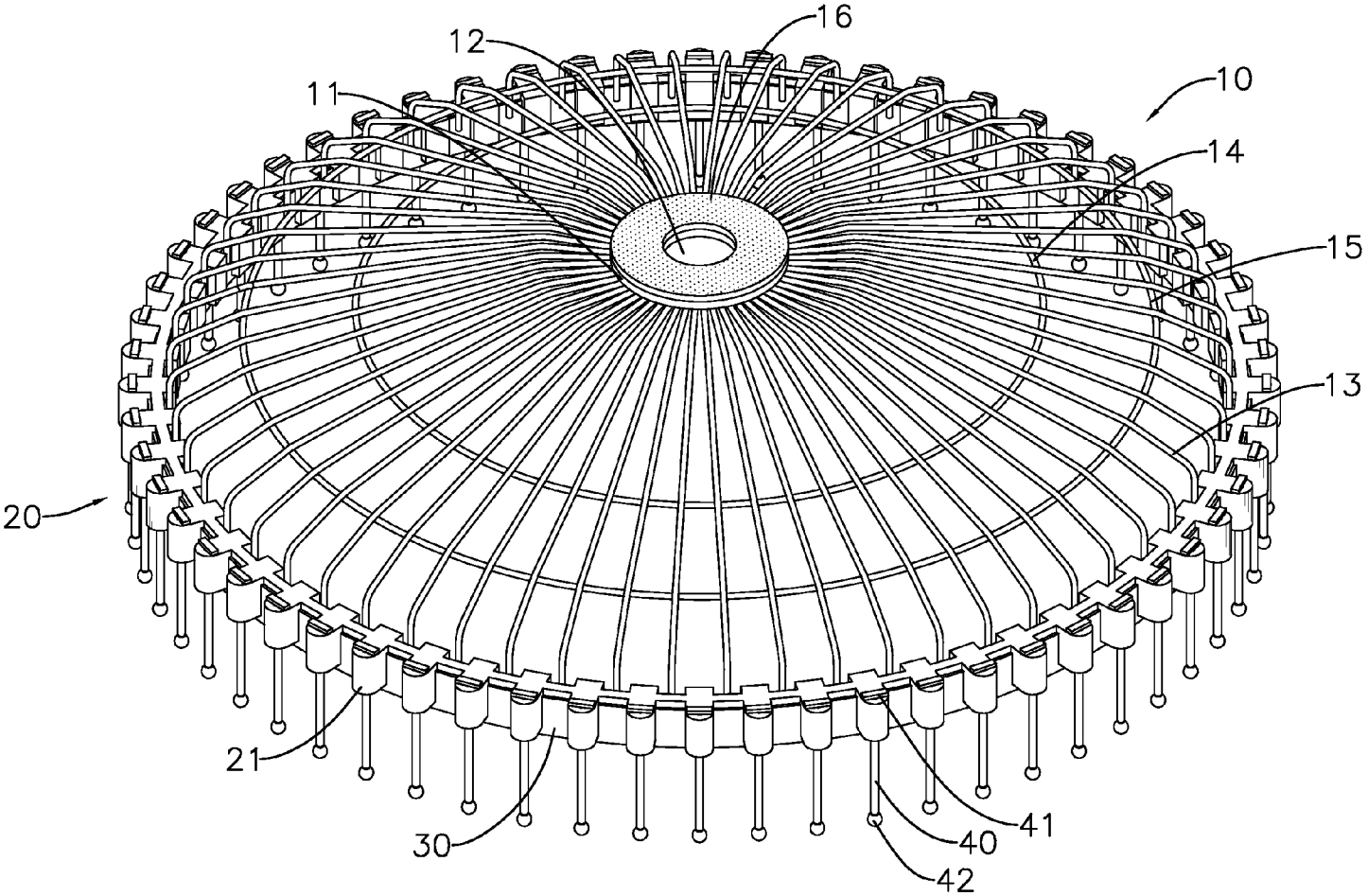
FIG. 1 is a perspective view of a first embodiment of a movable filter grid for a drain inlet in accordance with the present invention.

With reference to FIG. 1, a first embodiment of a movable filter grid for a drain inlet in accordance with the present invention has a drain grill 10, an annular fastener 20 and an annular seat 30.

The drain grill 10 has at least one support ring, an annular plate 11, and multiple support ribs 13. In the present embodiment, the at least one support ring includes a first support ring 14 and a second support ring 15. The annular plate 11 is positioned centrally on the drain grill 10, and has an opening 12 formed through the annular plate 11 for users to conveniently carry the movable filter grid. The annular plate 11, the first support ring 14 and the second support ring 15 are concentrically arranged in an outward direction. A first end of each support rib 13 is connected to an outer circumferential edge of the annular plate 11, and a second end of the support rib 13 radially extends outwards from the annular plate 11 and is sequentially securely connected with the first support ring 14 and the second support ring 15.

In the present embodiment, the annular plate 11 further has a reflector 16 mounted on a top of the annular plate 11 in generation of a reflective effect at night to alert passers-by to stay away from the movable filter grid.

Figure 2:
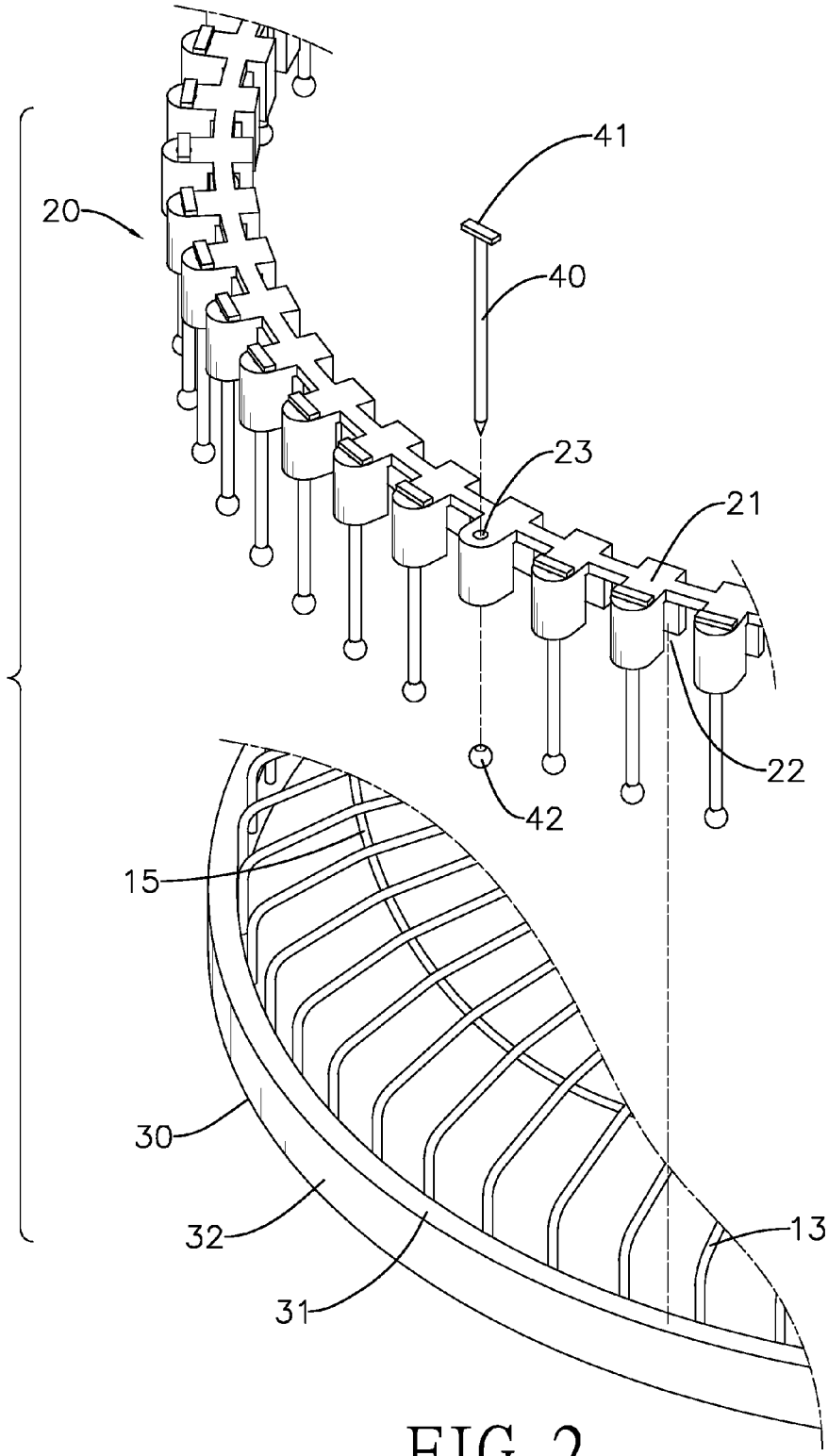
FIG. 2 is a partially enlarged and exploded perspective view of the movable filter grid in FIG. 1.

An inner wall of the annular seat 30 is securely connected with the second end of each support rib 13. With reference to FIG. 2, the annular seat 30 has a top edge face 31 and an outer wall 32.

The annular fastener 20 has multiple pin holders 21 annularly connected. Each pin holder 21 has a holding slot 22 and a through hole 23. The holding slot 22 is formed in a bottom of the pin holder 21 for the pin holder 21 to be mounted on the annular seat 30. The through hole 23 is longitudinally formed through an outer edge portion of the pin holder 21. A pin 40 is detachably mounted through each through hole 23. The inserted pins 40 are mutually spaced apart by a space and take the form of a grating.

The annular fastener 20 may be integrally formed. When the annular fastener 20 is integrally formed by an injection molding, the pin holders 21, the holding slots 22 and the through holes 23 are pre-formed by the mold to facilitate the manufacture of the annular fastener 20.

The pins 40 are smaller than the through holes 23 in diameter. Hence, the pins 40 can be inserted through the corresponding through holes 23. Each pin 40 has a holding end 41 and a bead 42. The holding end 41 is horizontally formed on one end of the pin 40. A length of the holding end 41 of the pin 40 is larger than the diameter of the through hole 23 of a corresponding pin holder 21. The bead 42 has a recess formed in the bead 42 for the other end of the pin 40 to be inserted in the bead 42. The pin 40 may be a long nail, a short nail, or the like. The bead 42 may be a protection cap.

Figure 3:
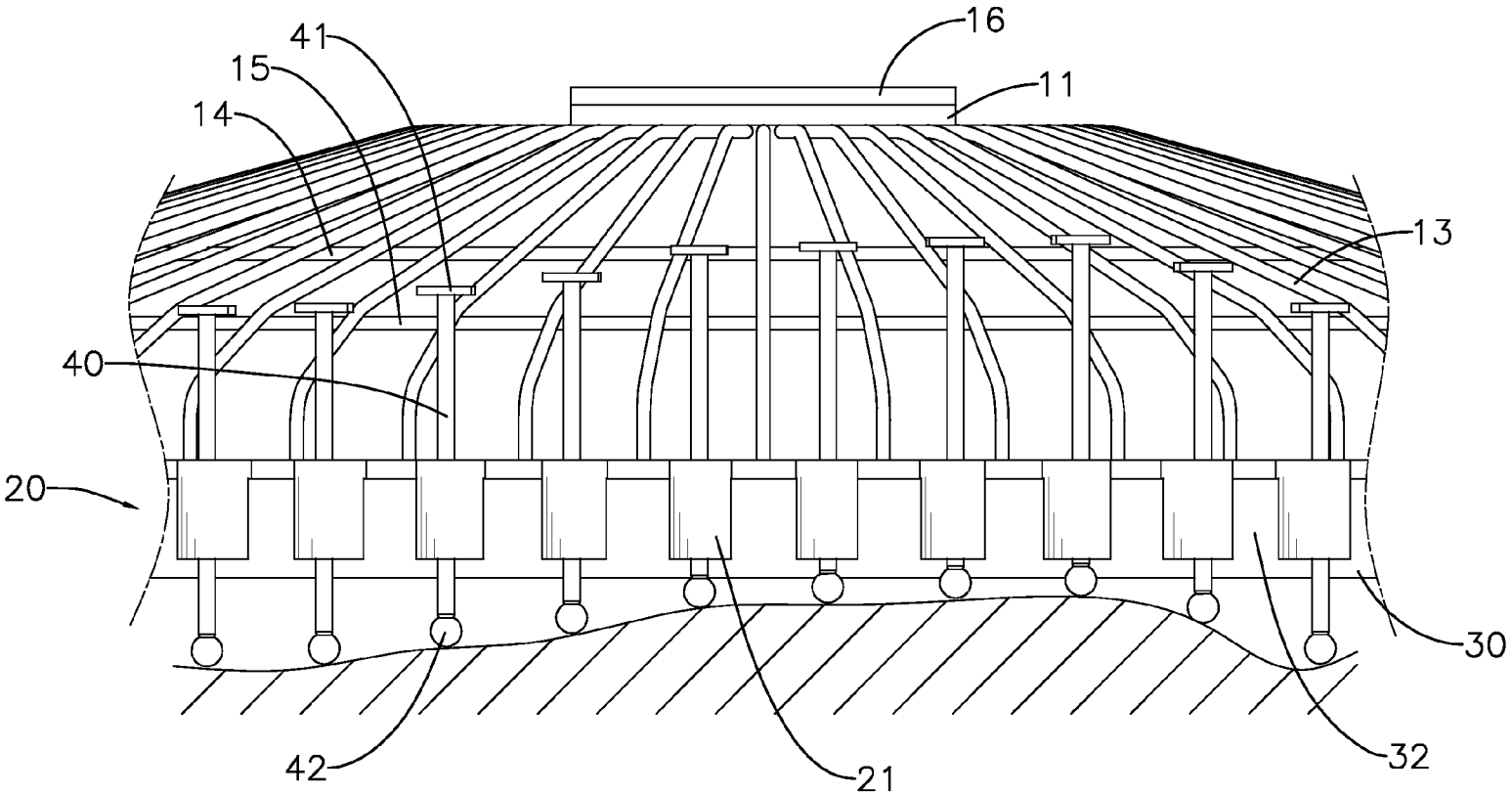
FIG. 3 is an operational partial enlarged side view of the movable filter grid in FIG. 1 mounted on a non-flat ground.

With reference to FIG. 3, the movable filter grid can be mounted on a drain inlet during a rainy day or when water flows on the ground. Rain water enters the drain inlet through spaces between the support ribs 13, and debris, such as garbage, tree branch, tree leaves and the like, are blocked out. However, if the ground around the drain inlet is non-flat, gaps are formed between the annular seat 30 and the irregular ground surface, thereby reducing the filtering effect. The pins 40 are movably mounted through the through holes 23 of the corresponding pin holders 21 and are aligned in the form of a grating. The holding end 41 of each pin 40 is moved to adjust the bead 42 of the pin 40 for the bead 42 to contact the ground. Portions of the pins 40 between the ground and the annular fastener 20 are aligned in the form of a grating to effectively filter the debris and prevent the debris from entering through the gaps between the ground and the annular seat 30. After all the beads 42 contact the ground, portions of the pins 40 above the annular seat 30 are also aligned in the form of a grating to fence off the drain grill 10 and block out the debris. If the ground around the drain inlet is flat, the holding end 41 of each pin 40 is moved upwards so that the annular seat 30 can contact the ground. Moreover, blockage caused by small-size debris, such as hairs, crushed stones, rubber band and the like, can be easily cleaned up by lifting up the movable filter grid through the opening 12 of the annular plate 11 and removing the debris.

Figure 4:
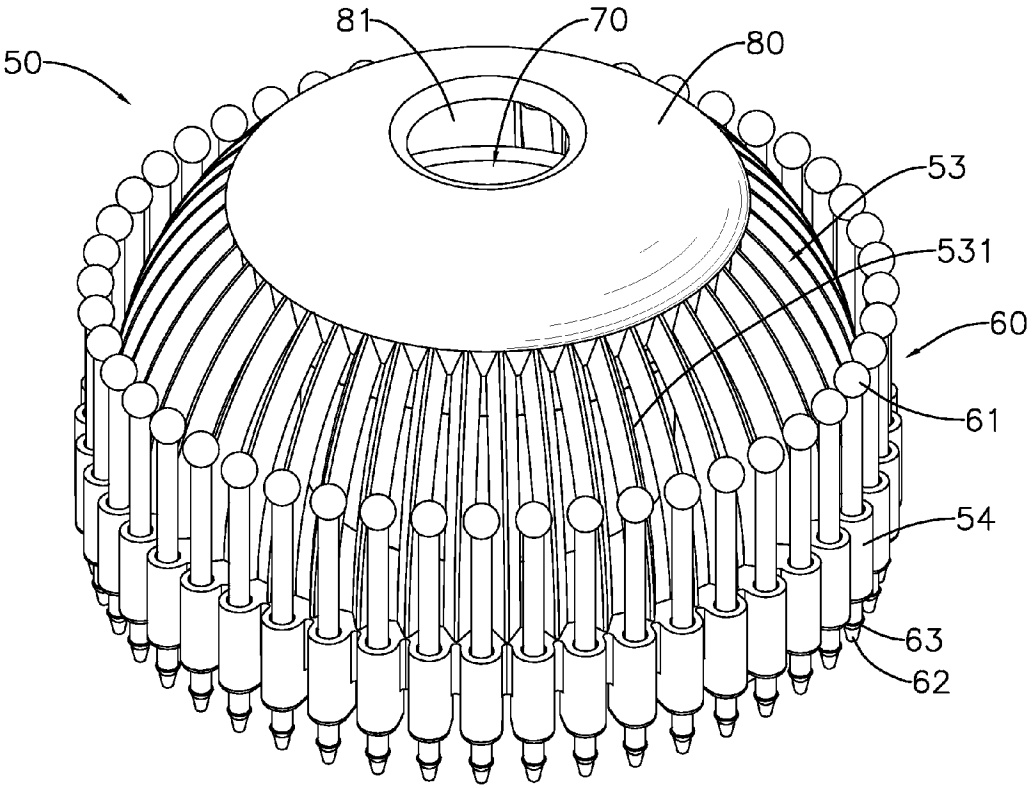
FIG. 4 is a perspective view of a second embodiment of a movable filter grid for a drain inlet in accordance with the present invention.
Figure 5:
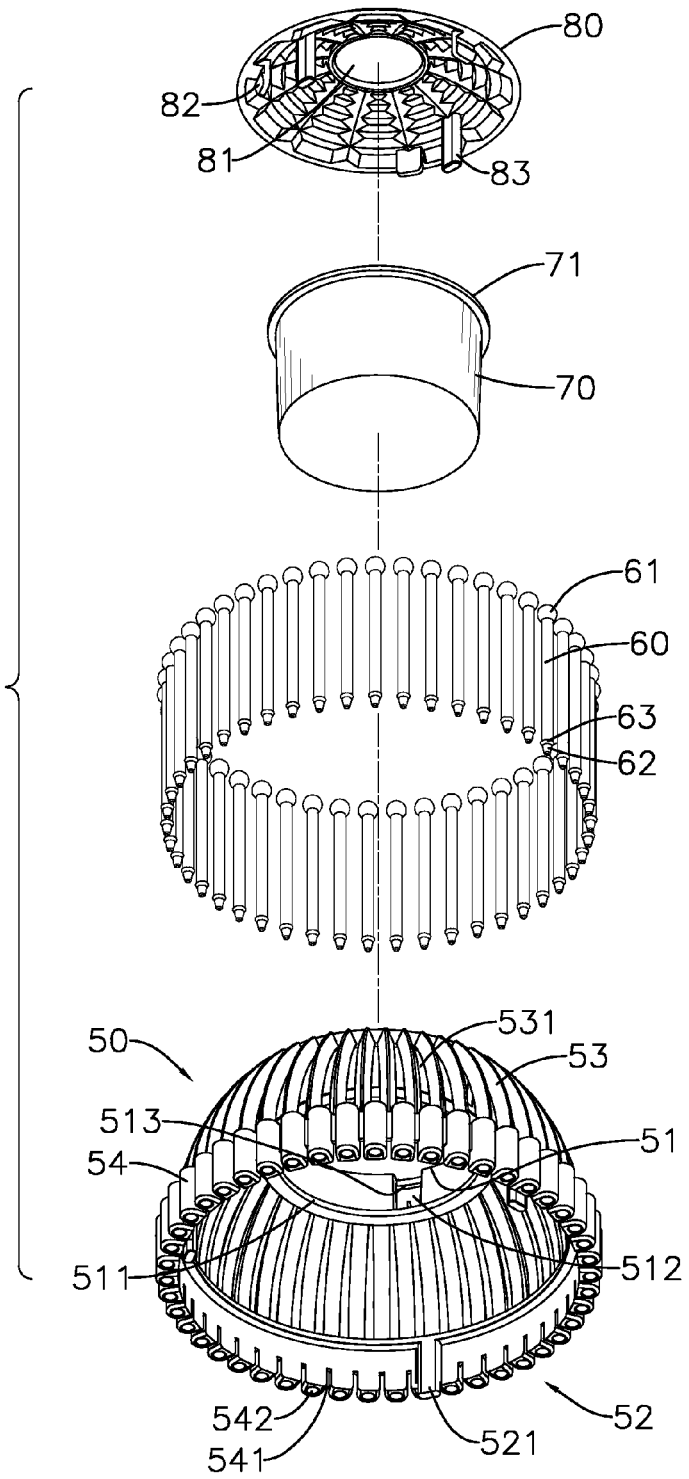
FIG. 5 is an exploded perspective view of the movable filter grid in FIG. 4.

With reference to FIGS. 4 and 5, a second embodiment of a movable filter grid for a drain inlet in accordance with the present invention has a drain grill 50, a cup 70, multiple pins 60 and a top lid 80.

The drain grill 50 has an upper ring 51, a lower ring 52 and multiple support ribs 53. The upper ring 51 and the lower ring 52 are respectively formed on a top end and a bottom end of the drain grill 50. The support ribs 53 are radially formed between the upper ring 51 and the lower ring 52 with each adjacent two of the support ribs 53 spaced apart by a gap to form a first drain hole 531.

The cup 70 is mounted on the upper ring 51 through an opening of the upper ring 51 and is securely held by an inner wall of the upper ring 51, and can be loaded with a heavy weight, such as a concrete block, a lead block and the like, to get a stable center of gravity of the drain grill for the movable filter grid to be firmly placed on the ground. In the present embodiment, the upper ring 51 has an annular inner flange 511, multiple water holes 512, and multiple first snap portions 513. The annular inner flange 511 is formed on and protrudes radially and inwards from a lower portion of the inner wall of the upper ring 51 to support the cup 70. A recessed portion of each water hole 512 is formed in the inner wall of the upper ring 51 and the remaining portion of the water hole 512 is formed through the inner wall of the upper ring 51. Each first snap portion 513 is horizontally formed in the recessed portion of the water hole 512. The cup 70 has an annular outer flange 71 formed on and protruding radially and outwards from a cup rim of the cup 70 to correspond to the annular inner flange 511 so that the outer flange 71 can be rested on the annular inner flange 511 when the cup 70 is mounted on the upper ring 51.

The lower ring 52 has multiple tubes 54 and multiple second drain holes 541. The tubes 54 are annularly formed on an outer periphery of the lower ring 52 and are mutually spaced apart by a space. Each tube 54 has a through hole 542 longitudinally formed through an outer edge portion of the tube 54. Each second drain hole 541 is formed between adjacent two of the tubes 54. In the present embodiment, the tubes 54 are resilient and the pins 60 can be respectively movably inserted into the through holes 542 of the tube 54 in a longitudinal direction and to take the form of a grating. The lower ring 52 further has multiple bottom pillars 521 formed on an inner surface of the lower ring 52. The bottom pillars 521 are longer than the tubes 54, and support the drain grill 50 to stand on the ground. Hence, the draining function of the movable filter grid is not affected when a bottom side of the lower ring 52 is sunken and fully contacts the ground due to the heavy weight loaded in the cup 70.

Figure 6:
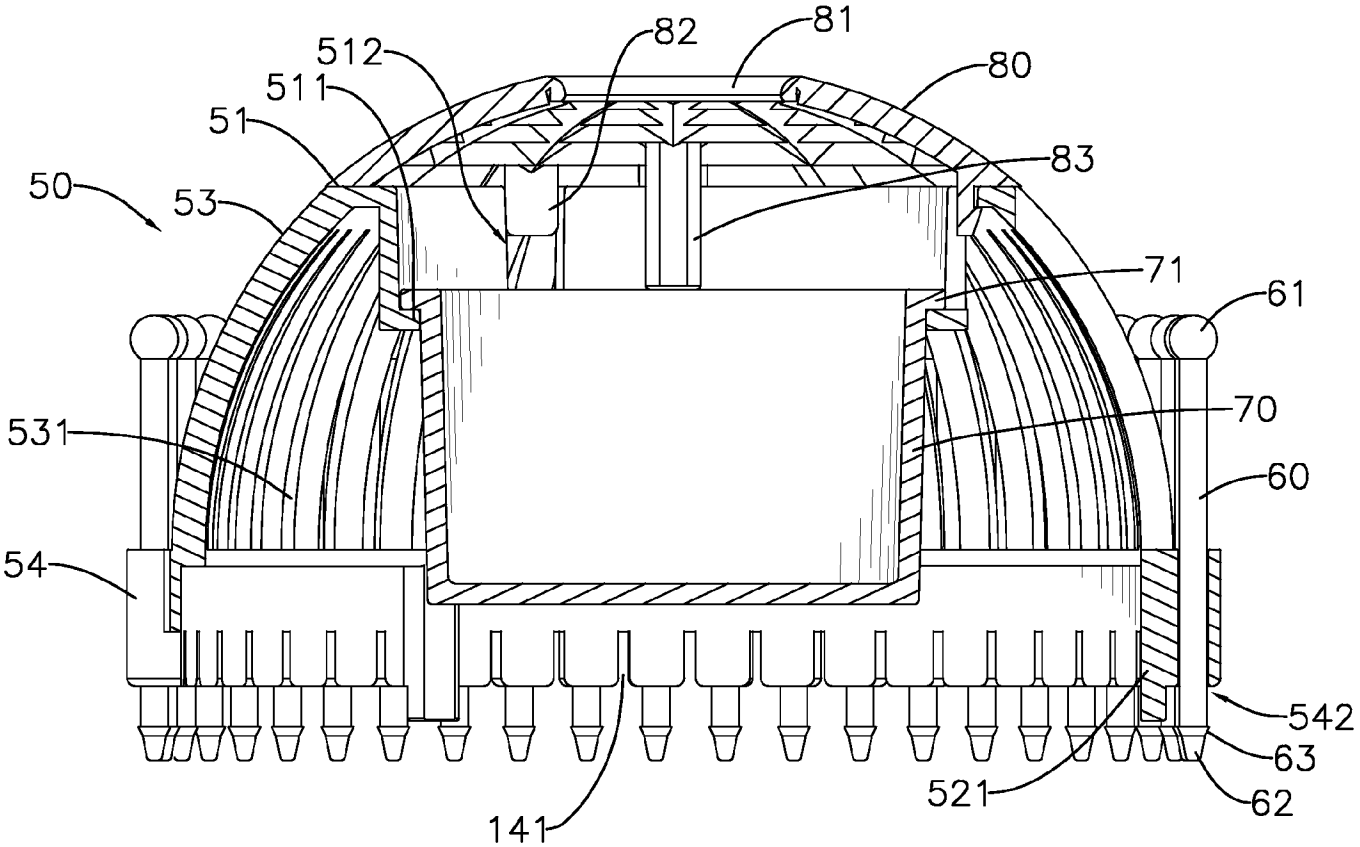
FIG. 6 is a side view in partial section of the movable filter grid in FIG. 4.

With reference to FIGS. 5 and 6, each pin 60 has a stopper 61, a conical tip 62 and an annular flange 63. The stopper 61 is formed on a top end of the pin 60. The conical tip 62 is formed on a bottom end of the pin 60. The annular flange 63 is formed on and radially protrudes outwards from a top end of the conical tip 62. An outer diameter of the annular flange 63 of each pin 60 is larger than an inner diameter of the through hole 542 of a corresponding tube 54 to ensure that the pin 60 can be retained inside the corresponding tube 54.

The top lid 80 covers the top ring 51 and has a top opening 81 for the ease of hand-carrying. In the present embodiment, the top lid 80 is bowl-shaped, and has multiple second snap portions 82 formed on and protruding downwards from an inner surface of the top lid 80. Each second snap portion 82 engages a corresponding first snap portion 513 on the inner wall of the upper ring 51 for the top lid 80 to be firmly mounted on the drain grill 50. In the present embodiment, the top lid 80 further has multiple top pillars 83. The top pillars 83 are formed on and protrude downwards from the inner surface of the top lid 80, and abut against a top surface of the annular outer flange 71 of the cup 70 so that the cup 70 can be firmly mounted inside the drain grill 50.

In the present embodiment, the top lid 80 further has a reflector mounted on a top surface of the top lid 80 in generation of a reflective effect at night to alert passers-by to stay away from the movable filter grid.

Figure 7:
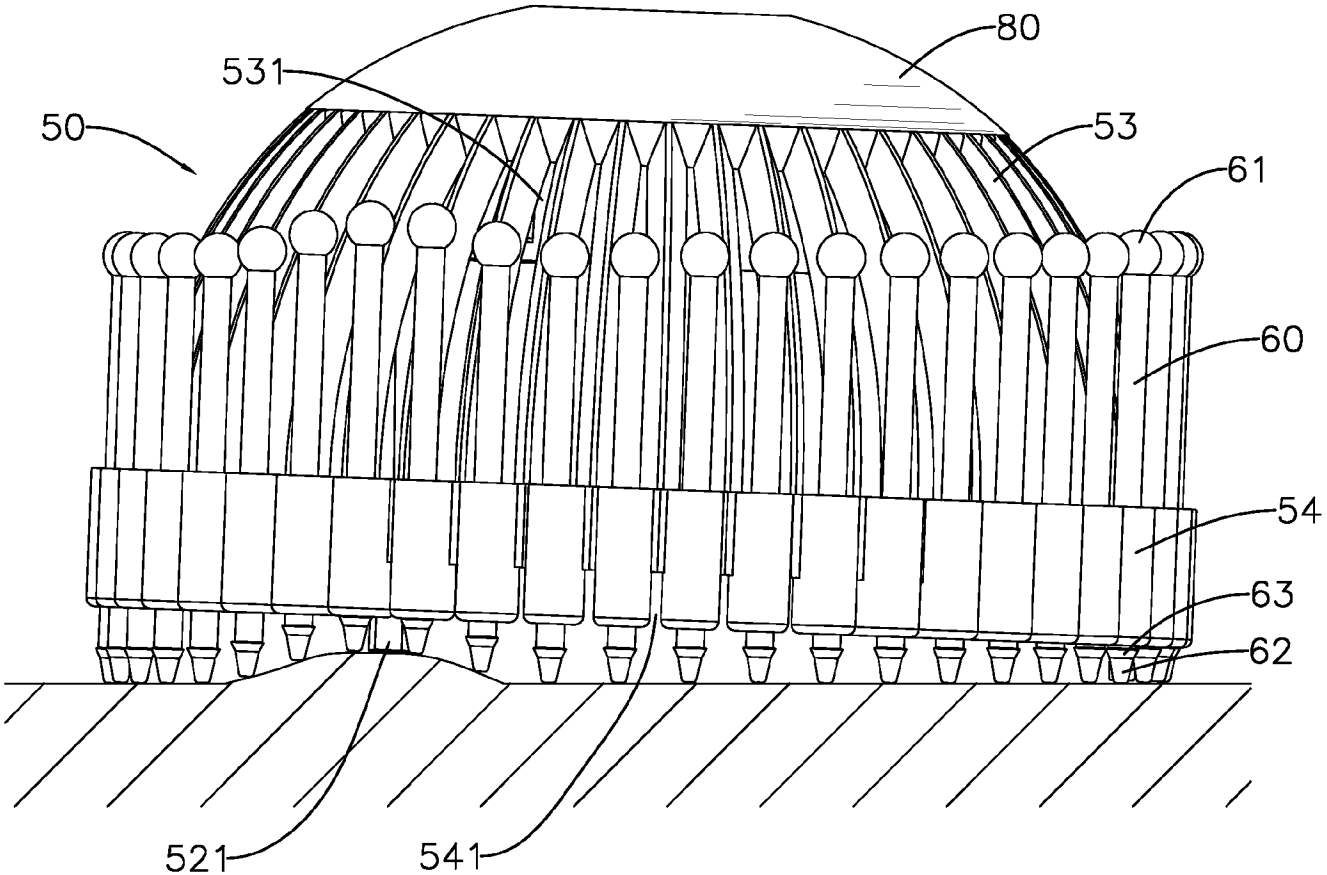
FIG. 7 is an operational side view of the movable filter grid in FIG. 4 mounted on a non-flat ground.
Figure 8:
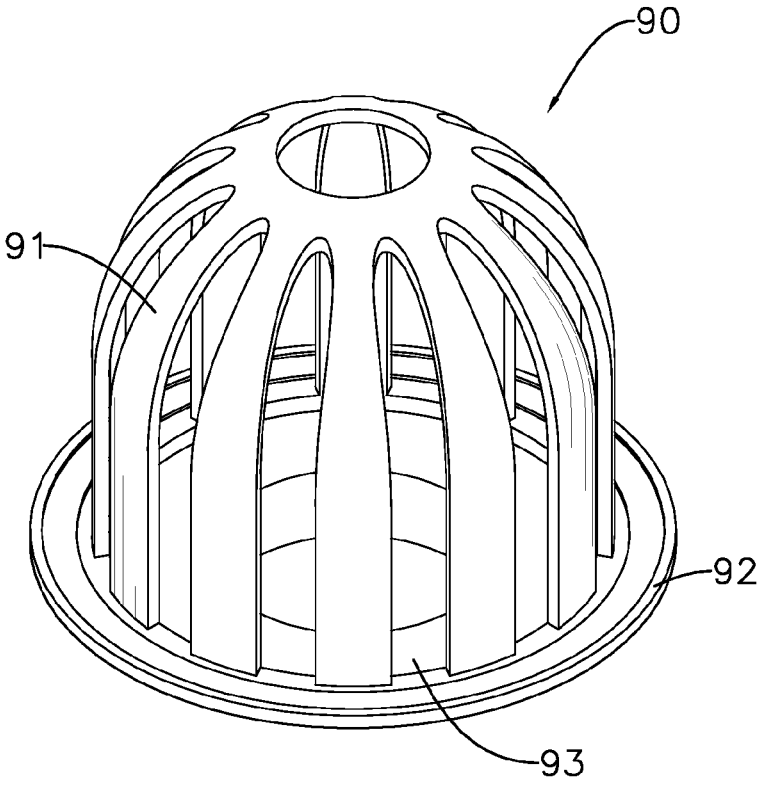
FIG.8 PRIOR ART
FIG. 8 is a perspective view of a conventional drain grate.

With reference to FIG. 7, operation of the present embodiment is shown. During a rainy day or when water flows on the ground, the movable filter grid can be placed on a drain inlet.

Rain water enters the drain inlet through the first drain holes 531 between the support ribs 53, and debris, such as garbage, tree branches, tree leaves, and the like, are blocked out. However, if the ground around the drain inlet is non-flat, gaps are formed between the drain grill 50 and the irregular ground surface, thereby reducing the filtering effect. The pins 60 are movably mounted through the tubes 54 and are aligned in the form of a grating. The stopper 61 of each pin 60 is moved to adjust the conical tip 62 of the pin 60 for the conical tip 62 to contact the ground. Portions of the pins 60 between the ground and the tubes 54 are aligned in the form of a grating to effectively filter the debris and prevent the debris from entering through the gaps between the ground and the tubes 54. After all the conical tips 62 contact the ground, portions of the pins 60 above the tubes 54 are also aligned in the form of a grating to fence off the drain grill 50 and block out the debris. If the ground around the drain inlet is flat, the stopper 61 of each pin 60 is moved upwards so that the conical tips 62 can contact the ground and the tubes 54 descend. The bottom pillars 521 of the lower ring 52 can maintain a height of the drain grill 50 relative to the ground to avoid reduced water drainage. Moreover, blockage caused by small-size debris, such as hairs, crushed stones, rubber band and the like, can be easily cleaned up by lifting up the movable filter grid through the top opening 81 of the top lid 80 and removing the debris.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A movable filter grid for a drain inlet, comprising:
a drain grill having:
an annular plate; and
multiple support ribs, wherein a first end of each support rib is connected to an outer circumferential edge of the annular plate, and a second end of the support rib radially extends outwards from the annular plate;
an annular seat, wherein an inner wall of the annular seat is securely connected to the second ends of the support ribs; and
an annular fastener having multiple pin holders annularly connected, each pin holder having:
a holding slot formed in a bottom of the pin holder for the pin holder to be mounted on the annular seat; and
a through hole formed through an outer edge portion of the pin holder, each through hole detachably mounted through by a pin, wherein the pins take a form of a grating.

2. The movable filter grid as claimed in claim 1, wherein each pin has:
a holding end horizontally formed on one end of the pin, wherein a length of the holding end of the pin is larger than a diameter of the through hole of a corresponding pin holder; and
a bead having a recess formed in the bead for the other end of the pin to be inserted in the bead.

3. The movable filter grid as claimed in claim 2, wherein the drain grill further has at least one support ring; and
the annular plate and the at least one support ring are concentrically arranged in an outward direction and sequentially securely connected with the support ribs.

4. The movable filter grid as claimed in claim 3, wherein the annular plate has:
an opening formed through the annular plate; and
a reflector mounted on a top of the annular plate;
the pin is a nail; and
the bead is a protection cap.

5. A movable filter grid for a drain inlet, comprising:
a drain grill having:
an upper ring formed on a top end of the drain grill;
a lower ring formed on a bottom end of the drain grill and having multiple tubes annularly formed on an outer periphery of the lower ring and mutually spaced apart by a space, wherein each tube has a through hole formed through the tube; and
multiple support ribs radially formed between the upper ring and the lower ring; and
multiple pins respectively movably inserted into the through holes of the tube and taking the form of a grating.

6. The movable filter grid as claimed in claim 5, further comprising a cup mounted on the upper ring with a cup rim of the cup engaging an inner wall of the upper ring, and the cup loaded with a weight to get a stable center of gravity for the drain grill.

7. The movable filter grid as claimed in claim 6, further comprising a top lid covering the upper ring and having a top opening for the ease of hand-carrying, wherein the lower ring further has multiple bottom pillars formed on inner surfaces of the tubes, and the bottom pillars being higher than the lower ring.

8. The movable filter grid as claimed in claim 7, wherein the upper ring has:
an annular inner flange formed on and protruding radially and inwards from a lower portion of the inner wall of the upper ring; and
multiple water holes formed through the inner wall of the upper ring; and
the cup has an annular outer flange formed on and protruding radially and outwards from the cup rim of the cup to correspond to the annular inner flange of the upper ring.

9. The movable filter grid as claimed in claim 8, wherein
each water hole has a first snap portion horizontally formed in a recessed portion of the water hole; and
the top lid further has multiple second snap portions formed on and protruding downwards from an inner surface of the top lid, wherein each second snap portion engages a corresponding first snap portion on the inner wall of the upper ring.

10. The movable filter grid as claimed in claim 9, wherein each pin has:
a stopper formed on a top end of the pin;
a conical tip formed on a bottom end of the pin; and
an annular flange formed on and radially protruding outwards from a top end of the conical tip, wherein an outer diameter of the annular flange of each pin is larger than an inner diameter of the through hole of a corresponding tube; and
the top lid further has multiple top pillars formed on and protruding downwards from the inner surface of the top lid, and abutting against a top surface of the annular outer flange of the cup.

* * * * *